United States Patent [19]

Sprengling et al.

[11] 4,111,715

[45] Sep. 5, 1978

[54] APPARATUS AND METHOD FOR CHEMICALLY REMOVING PLASTICS

[75] Inventors: Gerhard R. Sprengling, Derry Township, Westmoreland County; Leonard E. Edelman, Penn Hills Township, Allegheny County, both of Pa.

[73] Assignee: Westinghouse Electric Corp., Pittsburgh, Pa.

[21] Appl. No.: 666,808

[22] Filed: Mar. 15, 1976

[51] Int. Cl.[2] ..... B08B 7/04; C23G 1/36

[52] U.S. Cl. ..... 134/10; 134/26; 134/98; 134/103; 134/105; 137/255; 137/565; 137/572; 220/85 S

[58] Field of Search ..... 134/10, 26, 27, 30, 134/38, 95, 96, 98, 99, 103, 104, 105, 111; 137/255, 572, 565; 220/85 S; 222/148; 165/95

[56] References Cited

U.S. PATENT DOCUMENTS

| | | | |
|---|---|---|---|
| 1,460,695 | 7/1923 | Bannon | 137/255 |
| 1,568,789 | 1/1926 | Williams | 137/255 |
| 1,749,235 | 3/1930 | Stafford et al. | 220/85 S |
| 2,665,772 | 1/1954 | Green et al. | 134/111 |
| 2,702,042 | 2/1955 | Smith | 134/96 |
| 2,967,120 | 1/1961 | Chaney | 134/99 |
| 3,207,486 | 9/1965 | Rosenthal | 134/98 |
| 3,319,704 | 5/1967 | Nasse | 165/95 |
| 3,424,614 | 1/1969 | Lichte | 134/10 |
| 3,506,628 | 4/1970 | Hopkins | 137/572 |
| 3,774,625 | 11/1973 | Wiltrout | 134/104 |
| 3,893,625 | 7/1975 | Wiggins | 137/572 |
| 4,019,524 | 4/1977 | Whitson et al. | 137/572 |

*Primary Examiner*—S. Leon Bashore
*Assistant Examiner*—George C. Yeung
*Attorney, Agent, or Firm*—R. D. Fuerle

[57] ABSTRACT

An apparatus and method are disclosed for stripping plastics from articles such as motors by use of a stripping fluid. The apparatus has two heated tanks each having a large lid with a gas exit, a third tank, and means for pumping fluid between any two of the tanks. After the stripping fluid in one heated tank has removed the plastic from articles in that tank, it is pumped to the second heated tank and a washing fluid is pumped from the third tank to the first tank. A fourth tank may also be used to hold excess when a heated tank capacity is not being fully utilized.

15 Claims, 1 Drawing Figure

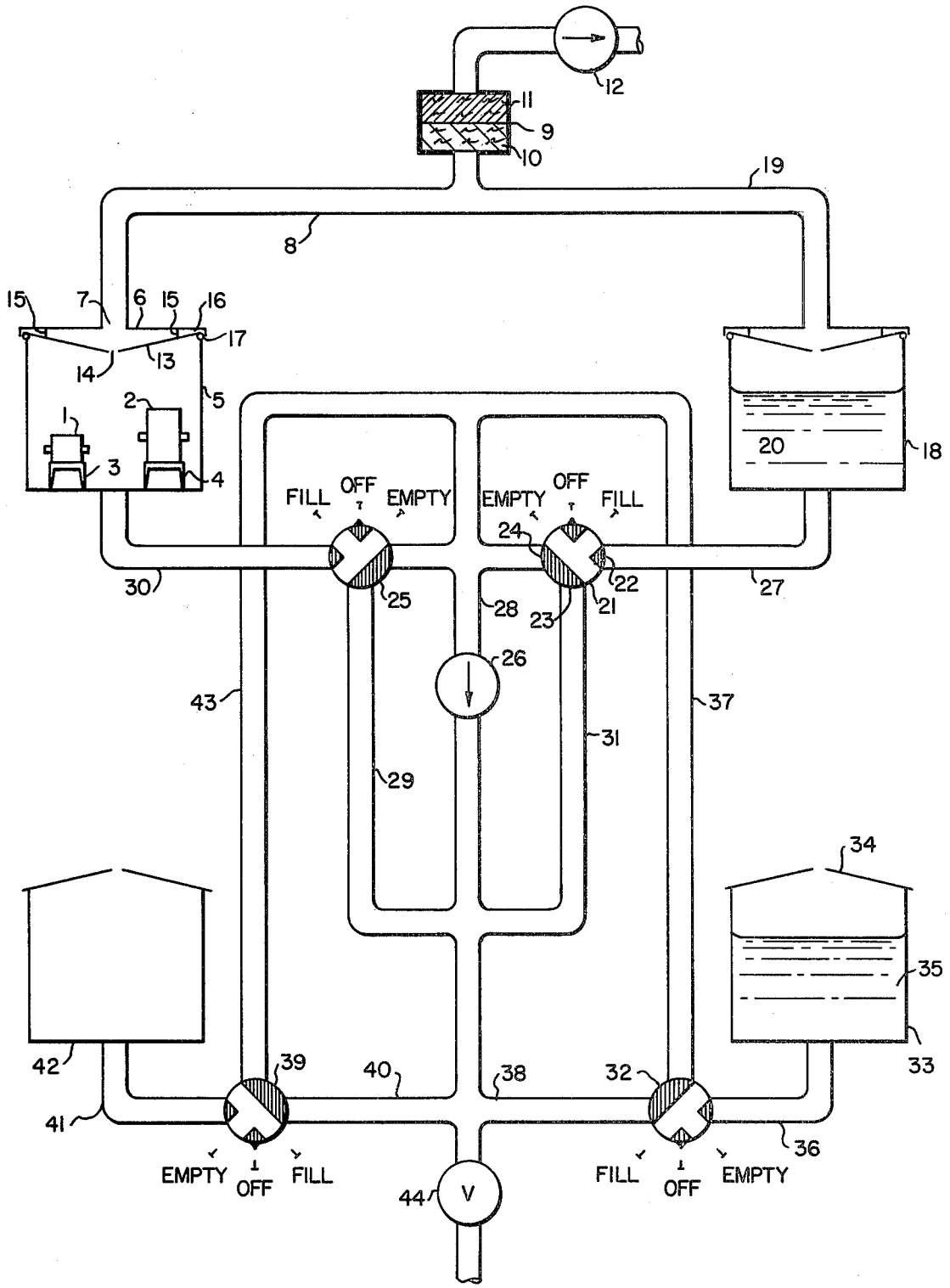
12
11
9
10
19
8
15
7
6
15
16
17
14
13
5
2
1
3
4
20
18
FILL
OFF
EMPTY
EMPTY
OFF
FILL
24
22
30
25
28
23
21
27
26
43
37
31
29
34
35
42
39
40
38
32
33
41
36
EMPTY
OFF
FILL
44
V
FILL
OFF
EMPTY

APPARATUS AND METHOD FOR CHEMICALLY REMOVING PLASTICS

BACKGROUND OF THE INVENTION

In order to repair motors by rewinding them the old insulation must be removed or loosened and the coils separated from the cores. This can be accomplished by placing the motor in a stripping fluid which attacks the organic insulation. Such fluids are disclosed in U.S. Pat. Nos. 2,417,468; 3,335,087, 2,242,106; 3,653,099; 3,551,204, and elsewhere.

Stripping fluids are often very reactive and dangerous chemicals, and since they are often heated to increase their chemical activity they may produce fumes which are noxious, toxic, or flammable. Therefore, it is important that the apparatus in which they are used be capable of safely handling them, yet not be so complicated that the rapid stripping of successive articles is impeded.

SUMMARY OF THE INVENTION

We have invented an apparatus for removing plastics from articles by chemical stripping. Our apparatus employs three interconnected tanks, two of which are heated and provided with gas exits. Fluid can be pumped between any two of the tanks in the apparatus even though only a single pump is used.

The apparatus is efficient because articles are continuously being stripped in one of the two heated tanks. while articles in one tank are being stipped, articles in the other tank are being washed, removed, and replaced by additional articles to be stripped. The stripping fluid is then pumped from one heated tank to the other and the process continues.

The apparatus is also very safe because each heated tank is provided with a lid and gas exit. The articles are loaded into a cool empty tank instead of into a hot liquid, and the stripped articles can be washed and cooled before they need be removed and handled.

DESCRIPTION OF THE INVENTION

The accompanying drawing is a diagrammatic view of a certain presently preferred embodiment of our invention.

In the drawing, motors 1 and 2, which are to be stripped, have been placed on stands 3 and 4, respectively, in tank 5. The tank is heated by means not shown and is provided with a lid 6 which is comparable in size to the cross-sectional area of the tank so that articles can be easily inserted and removed. The lid has a gas exit 7 connected by conduit 8 to filter holder 9 which is provided with an impingement filter 10 for collecting solids and an activated charcoal filter 11 for absorbing gases. A blower 12 on the conduit exhausts the remaining gases. The lid of tank 5 is preferably provided with a conical, thin, flexible inner lid 13 having a small aperture 14 at its center. The inner lid is held to lid 6 by brackets 15, which separate the two lids to provide a narrow space 16 at the edges so that a low volume air flow through the fume disposal system will reach, in the area adjacent seal 17, a velocity high enough to catch and entrain reliably any fumes escaping past possible imperfections in that seal or its contact with inner lid 13. It is the function of this inner lid to condense vapors and permit them to drop back into the tank.

Seal 17 is preferably of a material not attacked by the stripping fluid. This seal not only keeps vapors in, but it also thermally insulates the lid from the sides of the tank, thus keeping the lid cooler and aiding in the condensation of the stripping fluid. Polytetrafluoroethylene (Teflon) is the preferred seal material because it is flexible and not attacked by most stripping fluids, but aromatic polyimides and other materials could be used in some instances.

A second heated tank 18 is equipped in the same way as tank 5 and the gas exit of its lid is also connected to filter holder 9 by a conduit 19.

To start the stripping process, tank 18 is filled with the stripping fluid 20. Three-way valve 21 having inlet-outlet port 22, outlet port 23, and inlet port 24 is turned to "empty," three-way valve 25 is turned to "fill," and blower 12 and pump 26 are turned on. Pump 26 is preferably a centrifugal pump with large rotor clearances because the stripping fluid may accumulate pieces of stripped insulation. A filter (not shown) upstream of the pump which is periodically cleaned may be used to remove debris from the fluids. The stripping fluid is thereby pumped through conduit 27 to valve 21 to conduit 28 to pump 26, conduit 29, valve 25, conduit 30, and into tank 5. Valves 21, 25, and pump 26 are turned off and tank 18 is opened, filled with articles to be stripped, and closed.

After motors 1 and 2 have been stripped, valve 25 is turned to "empty," valve 21 to "fill," and pump 26 is turned on. The stripping fluid is pumped from tank 5 through conduit 30, valve 25, conduit 28, pump 26, conduit 31, valve 21, conduit 27, and into tank 18. Valve 21 is turned to "off," valve 25 to "fill," and valve 32 to "empty."

Tank 33 is provided with a lid 34 and holds a washing fluid 35. The washing fluid is preferably one of the more innocuous components of the stripping fluid so that any washing fluid remaining in the tanks and conduits merely becomes part of the stripping fluid. The washing fluid is pumped through conduit 36, valve 32, conduit 37, conduit 28, pump 26, conduit 29, valve 25, and conduit 30 into tank 5 where it washes and cools the motors. Valves 25 and 32 and pump 26 are turned off during the wash, then valve 25 is turned to "empty," valve 32 to "fill," and pump 26 is turned on. The washing fluid is pumped from tank 5 through conduit 30, valve 25, conduit 28, pump 26, conduit 38, valve 32, conduit 36, and back into tank 33. Valves 25 and 32 and pump 26 are turned off. Motors 1 and 2 are removed from tank 5.

It is sometimes desirable to strip the insulation off a motor, but to leave the commutator insulation intact. In that event the motors are placed in tank 5 in a vertical position with their commutators up and with the bottom of the commutators at the same level. Again, stripping fluid is pumped from tank 18 into tank 5 as hereinbefore described. Now, however, when the stripping fluid reaches a level just below the bottom of commutators (a floating sensor, not shown, can indicate the fluid level in tank 5), valve 25 is turned off and valve 39 is turned to "fill." Thus, the remaining fluid in tank 18 is pumped through conduit 27, valve 21, conduit 28, pump 26, conduit 40, valve 39, conduit 41, and into heated overflow tank 42. The pump and valves are turned off, and tank 18 is washed and reloaded. When the motors in tank 5 have been stripped the fluid is pumped into tank 18 as described, then valve 25 is turned off and valve 39 is turned to "empty," and fluid is pumped from tank 42 through conduit 41, valve 39, conduits 43 and 28, pump 26, conduit 31, valve 21, and conduit 27 into tank 18.

The conduits are preferably thermally insulated when they are used to carry heated fluids. Protection of commutators can also be achieved by placing the motors on stands of appropriate height. The motors may also be placed in the tanks in baskets in order to collect the insulation which falls off. When it is necessary to remove a fluid from the apparatus valve 44 is opened and the fluid is pumped out.

Variations of the above-described apparatus are also contemplated. For example, each three-way valve can be replaced by two two-way valves, though a single three-way valve is preferred as it simplifies operation of the apparatus. Various types of lids may be used including hinged lids, lids with fluid-sealed edges lids with external condensers, and pressure cooker lids with a pressure-tight clamped seal but the lid shown is preferred as it is believed to be most practical.

The space between the inner and outer lids may be packed with steel wool to aid in condensation, but this is not believed to be necessary. The fluids may be transferred from tank to tank by means of air pressure inside the tanks, but a pump is preferred because it does not require tanks with air-tight seals.

We claim:

1. A method of stripping plastic from an article and of thereafter washing and cooling the stripped article, comprising:
   (1) placing said article in a first heated tank having a lid with a gas exit, said lid being comparable in size to the cross-sectional area of said tank;
   (2) closing said lid;
   (3) admitting a stripping fluid to said tank from a second similarly-equipped tank;
   (4) after said article has been stripped of said plastic by said stripping fluid, transferring said stripping fluid back to said second tank;
   (5) admitting a washing fluid from a third tank to said first tank;
   (6) transferring said washing fluid back to said third tank; and
   (7) opening the lid of said first tank and removing said stripped article therefrom.

2. Apparatus comprising
   (1) two heated tanks each having a removable lid with a gas exit, each lid being comparable in size to the cross-sectional area of its tank to that said cross-sectional area is substantially exposed when said lid is opened;
   (2) a third tank;
   (3) a one-way pump having an inlet and an outlet, conduits from each tank leading to said inlet and to said outlet, and three-way valves interconnecting said three tanks with said conduits for moving a fluid directly between any two of said three tanks without first passing through the third tank, said means including one and only one opening into each of said three tanks through which said fluid enters and leaves said tanks via said means.

3. Apparatus according to claim 2 including a heated overflow tank, a conduit between said pump inlet and said overflow tank, and a conduit between said pump outlet and said overflow tank, flow to and from said overflow tank being controlled by at least one valve.

4. Apparatus according to claim 3 wherein said heated tanks and said conduits between said pump and said heated tanks are thermally insulated.

5. Apparatus according to claim 2 wherein said lids comprise an inner lid and an outer lid and said inner lid is conical, has its lowest portion in the center, and said center is perforated.

6. Apparatus according to claim 2 wherein said lids are separated from said heated tanks by gaskets of thermally insulating material.

7. Apparatus according to claim 6 wherein said thermally insulating material is polytetrafluoroethylene.

8. Apparatus according to claim 2 wherein said gas exits are connected to a blower which blows away from said gas exits, and gases exiting from said gas exits are filtered before passing to said blower.

9. Apparatus according to claim 2 wherein said pump is a centrifugal pump.

10. Apparatus according to claim 2 wherein each tank has one and only one three-way valve, each three-way having an inlet-outlet port, an outlet port, and an inlet port, where a conduit leads from each tank to the inlet-outlet port of its valve, a conduit leads from the outlet port of each valve to the inlet port of said pump, and a conduit leads from the outlet port of each valve to the inlet port of said pump.

11. Apparatus according to claim 2 wherein at least one of said heated tanks contains a stripping fluid for stripping plastics from articles, and another of said tanks contains a washing fluid for washing said stripping fluid from stripped articles.

12. Apparatus according to claim 11 wherein said washing fluid is a component of said stripping fluid.

13. Apparatus for transferring a fluid between any number of tanks comprising
   (A) at least two tanks;
   (B) a one-way pump having an inlet port and an outlet port;
   (C) a three-way valve for each tank, each valve having
      (1) an inlet-outlet port;
      (2) an outlet port; and
      (3) an inlet port;
   (D) a conduit from each tank to the inlet-outlet port of its three-way valve;
   (E) a conduit from the outlet port of each valve to the inlet port of said pump; and
   (F) a conduit from the inlet port of each valve to the outlet port of said pump.

14. Apparatus according to claim 13 wherein there are three tanks.

15. Apparatus according to claim 13 wherein there are four tanks.

* * * * *